US006423944B2

(12) United States Patent
Watanabe et al.

(10) Patent No.: US 6,423,944 B2
(45) Date of Patent: Jul. 23, 2002

(54) CERAMIC HEATER AND GLOW PLUG WITH REFERENCE ZONE AND CONDENSED ZONE OF CERAMICS AND CONDUCTIVE PARTICLES DISPERSED THEREIN

(75) Inventors: Shindo Watanabe, Nagoya; Masahiro Konishi, Aichi, both of (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 09/767,860

(22) Filed: Jan. 24, 2001

(30) Foreign Application Priority Data

Jan. 25, 2000 (JP) ..... 2000-016163

(51) Int. Cl.[7] ..... F23Q 7/00
(52) U.S. Cl. ..... 219/270; 123/145 A; 219/544
(58) Field of Search ..... 219/270, 544, 219/541; 123/145 A, 145 R

(56) References Cited

U.S. PATENT DOCUMENTS 6,184,497 B1 * 2/2001 Leigh ..... 219/270
6,204,481 B1 * 3/2001 Ito ..... 219/270

FOREIGN PATENT DOCUMENTS

| | | |
|---|---|---|
| EP | 798 948 | 10/1997 |
| JP | 8-64346 | 3/1996 |

* cited by examiner

*Primary Examiner*—John A. Jeffery
(74) *Attorney, Agent, or Firm*—Sughrue Mion, PLLC

(57) ABSTRACT

A ceramic heater extending in an axial direction to have an elongate shape includes (a) a basal body; (b) a lead wire embedded in the basal body; and (c) a heating element embedded in the basal body. This heating element includes (1) a matrix ceramic phase; (2) conductive ceramic particles dispersed in the matrix ceramic phase; (3) a portion in which an end portion of the lead wire is embedded; and (4) a reference zone in terms of concentration of a particular element (e.g., rare-earth element). The heating element may include a condensed zone in terms of concentration of the particular element. The ceramic heater can be free from the condensed zone, or at least its formation is minimized to have a thickness of not greater than 5 $\mu$m. With this, the ceramic heater is improved in bending strength.

23 Claims, 5 Drawing Sheets

CERAMIC HEATER AND GLOW PLUG WITH REFERENCE ZONE AND CONDENSED ZONE OF CERAMICS AND CONDUCTIVE PARTICLES DISPERSED THEREIN

BACKGROUND OF THE INVENTION

The present invention relates to a ceramic heater and a glow plug equipped with the ceramic heater.

There are conventional ceramic heaters used for glow plugs and the like. Such ceramic heater contains a basal body made of an insulating ceramic (e.g., silicon-nitride-based sintered body) and a heating element (containing a conductive component (e.g., WC)) embedded in the basal body. Such ceramic heater further contains a lead wire (made of W or the like) of which end portion is embedded in the heating element. With this, the heating element is electrically connected with electrodes for energizing the heating element. The heating element is prepared by adding a conductive material (e.g., WC) to a silicon-nitride-based material and a sintering aid, then forming the resulting mixture into a compact, and then sintering the compact into the heating element. It is, however, difficult to sinter the silicon-nitride-based material and the conductive material. Thus, it may be difficult to obtain a heating element that is sufficiently compact, if the sintering aid is in a normal amount. Japanese Patent Laid-open Publication JP-A-8-64346 teaches a ceramic heater prepared by adding a relatively large amount of a sintering aid in order to sufficiently produce a liquid phase during sintering.

SUMMARY OF THE INVENTION

If a relatively large amount of a sintering aid is used in the production of a ceramic heater, an excess of the sintering aid may not be uniformly dispersed, but may form a condensed zone partly dispersed. This condensed zone has a higher concentration of the sintering aid, as compared with that of the remainder, and tends to occur at a periphery of a lead wire's end portion embedded in the heating element. Therefore, it may be necessary to improve strength of the vicinity of this end portion.

It is therefore an object of the present invention to provide a ceramic heater that has a sufficient bending strength even at its connected portion at which its lead wire's end portion is embedded in its heating element.

It is another object of the present invention to provide a glow plug equipped with such ceramic heater.

It is still another object of the present invention to provide a process for producing such ceramic heater.

According to the present invention, there is provided a ceramic heater extending in an axial direction to have an elongate shape. This ceramic heater comprises (a) a basal body; (b) a lead wire embedded in said basal body; and (c) a heating element embedded in said basal body. This heating element comprises (1) a matrix ceramic phase; (2) conductive ceramic particles dispersed in said matrix ceramic phase; (3) a portion in which an end portion of said lead wire is embedded; (4) a reference zone defined on a cross-section of said ceramic heater, said cross-section being defined as being perpendicular to said axial direction of said ceramic heater and as being disposed at a center of said end portion of said lead wire, said reference zone being away from said end portion of said lead wire by a distance of 40 $\mu$m, or greater; and (5) a condensed zone optionally contained in said heating element and having a thickness of 0–5 $\mu$m, said condensed zone being defined on said cross-section of said ceramic heater and defined as being a zone such that a concentration of an element contained in said matrix ceramic phase of said condensed zone is two times or greater an average concentration of said element contained in said matrix ceramic phase of said reference zone, said average concentration being defined in a direction along a thickness of said reference zone.

According to the present invention, there is provided a glow plug equipped with the ceramic heater.

According to the present invention, there is provided a process for producing the ceramic heater. This process comprises (a) providing a first precursor of said heating element, said first precursor comprising a first weight percent of a rare-earth element; (b) embedding said end portion of said lead wire in said first precursor to form a first precursory body; (c) embedding said first precursory body in a second precursor of said basal body to form a second precursory body, said second precursor comprising a second weight percent of a rare-earth element, a ratio of said first weight percent to said second weight percent being 0.5 or less; and (d) sintering said second precursory body into said ceramic heater.

DESCRIPTION OF THE PREFERRED EMBODIMENTS

Figure 4:
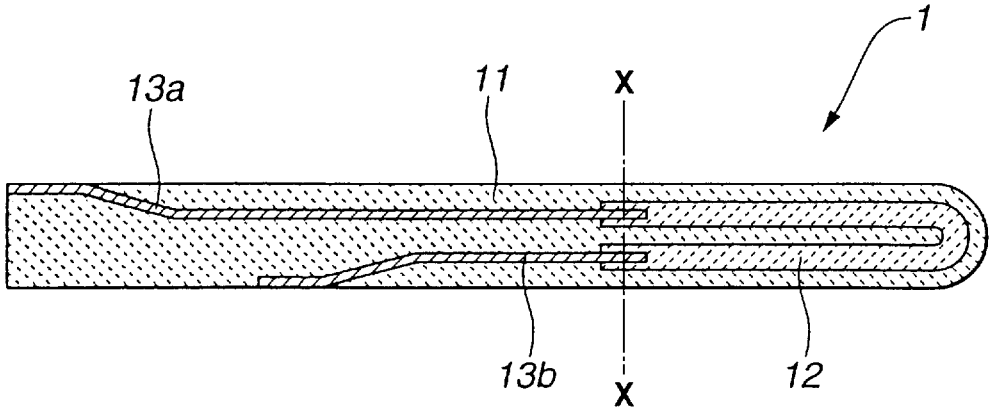
FIG. 4 is a longitudinal section of a ceramic heater according to the present invention.

As shown in FIG. 4, there is provided a ceramic heater 1 according to the present invention. This ceramic heater 1 includes a basal body 11, lead wires 13*a* and 13*b* and a heating element 12. The basal body 11 can be a silicon-nitride-based sintered body and serves to protect the heating element 12 and the lead wires 13*a* and 13*b*, which are embedded in the basal body 11 as shown in FIG. 4. The heating element 12 is a U-shaped rod-like body. The heating element 12 contains a matrix ceramic phase and conductive ceramic particles dispersed in the matrix ceramic phase. Each lead wire 13*a* or 13*b* has one end portion positioned on the surface of the basal body 11 and the other end portion embedded in one end portion of the heating element 12. Therefore, the lead wires 13*a* and 13*b* and the heating element 12 constitute an integral body embedded in the basal body 11. With this, it becomes possible to feed electric power from an outside to the heating element 12 through the lead wires 13*a* and 13*b* to generate heat.

Figure 5:
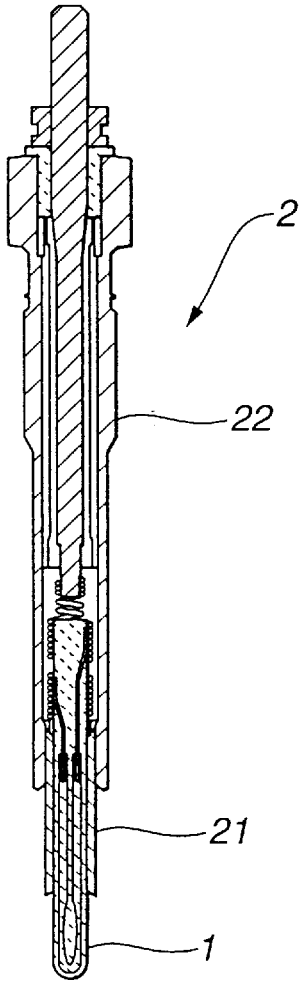
FIG. 5 is a longitudinal section of a glow plug equipped with a ceramic heater according to the present invention.

FIG. 5 shows a glow plug 2 according to the present invention. This glow plug 2 is equipped at its one end with the ceramic heater 1. This ceramic heater 1 is inserted in a fixing sleeve 21 made of a metal. This fixing sleeve 21 is supported on an end portion of an outer sleeve 22.

The matrix ceramic phase of the heating element 12 can be a silicon-nitride-based sintered body. The conductive ceramic particles of the heating element 12 can be prepared by sintering a material that is at least one compound of at least one metal. This at least one compound can be selected from silicides, carbides and nitrides, and this at least one metal can be selected from W, Ta, Nb, Ti, Mo, Zr, Hf, V and Cr. It is preferable that the conductive ceramic particles have a thermal expansion coefficient close to that of the silicon-nitride-based sintered body forming the basal body 11 or that of the silicon-nitride-based sintered body forming the matrix ceramic phase of the heating element 12. With this, it becomes possible to suppress the occurrence of cracks in the basal body 11 and the heating element 12 during the use of the ceramic heater 1. Such preferable conductive ceramic particles can be particles of a material selected from WC, $MoSi_2$, TiN and $WSi_2$. Furthermore, it is preferable that the conductive ceramic particles are improved in heat resistance. In fact, their melting point is preferably higher than the operating temperature of the ceramic heater. If their melting point becomes higher, the ceramic heater is improved in heat resistance in the operating temperature range. The quantitative relation between the matrix ceramic phase and the conductive ceramic particles is not particularly limited. In fact, the amount of the conductive ceramic particles may be 15-40 parts by volume, preferably 20–30 parts by volume, per 100 parts by volume of the heating element.

Each of the lead wires 13*a* and 13*b* can be made of a material that is a metal or an alloy containing this metal. This metal can be at least one selected from W, Re, Ta, Mo and Nb. Of these, W is preferable.

As stated above, the basal body 11 can be a silicon-nitride-based sintered body. In fact, this sintered body can be made of only silicon nitride or a material containing silicon nitride as a major component and a small mount of at least one additive (e.g., aluminum nitride, alumina and sialon (i.e., a material containing constituent elements of Si, Al, O and N)). Furthermore, it is optional to include a small amount of a ceramic component, which constitutes the conductive ceramic particles, in the basal body in order to reduce the difference of thermal expansion coefficient between the basal body and the conductive ceramic particles of the heating element.

Each of the heating element and the basal body may contain "a particular element" (e.g., a rare-earth element). This particular element can be included in the heating element or the basal body, if it is prepared by adding a sintering aid containing this particular element to its ceramic raw material (e.g., silicon nitride powder). This sintering aid is preferably in the form of power. Exemplary materials for this sintering aid are rare-earth element's oxides (e.g., $Yb_2O_3$ and $Er_2O_3$) and other oxides (e.g., MgO and $Al_2O_3$—$Y_2O_3$) generally used in sintering for producing silicon-nitride-based sintered bodies. It is optional to use a single sintering aid or a combination of at least two sintering aids in the preparation of the heating element. It is preferable to use a sintering aid (e.g., $Er_2O_3$), which turns grain boundaries into a crystalline phase after sintering, in order to improve the heating element in heat resistance. For example, if $Yb_2O_3$ is used as a sintering aid in the preparation of the heating element or the basal body, a rare-earth element of Yb is included therein as the above particular element. Upon sintering, the sintering aid turns into a liquid phase of a high melting point. Thus, its distribution after sintering may become uneven.

Figure 6:
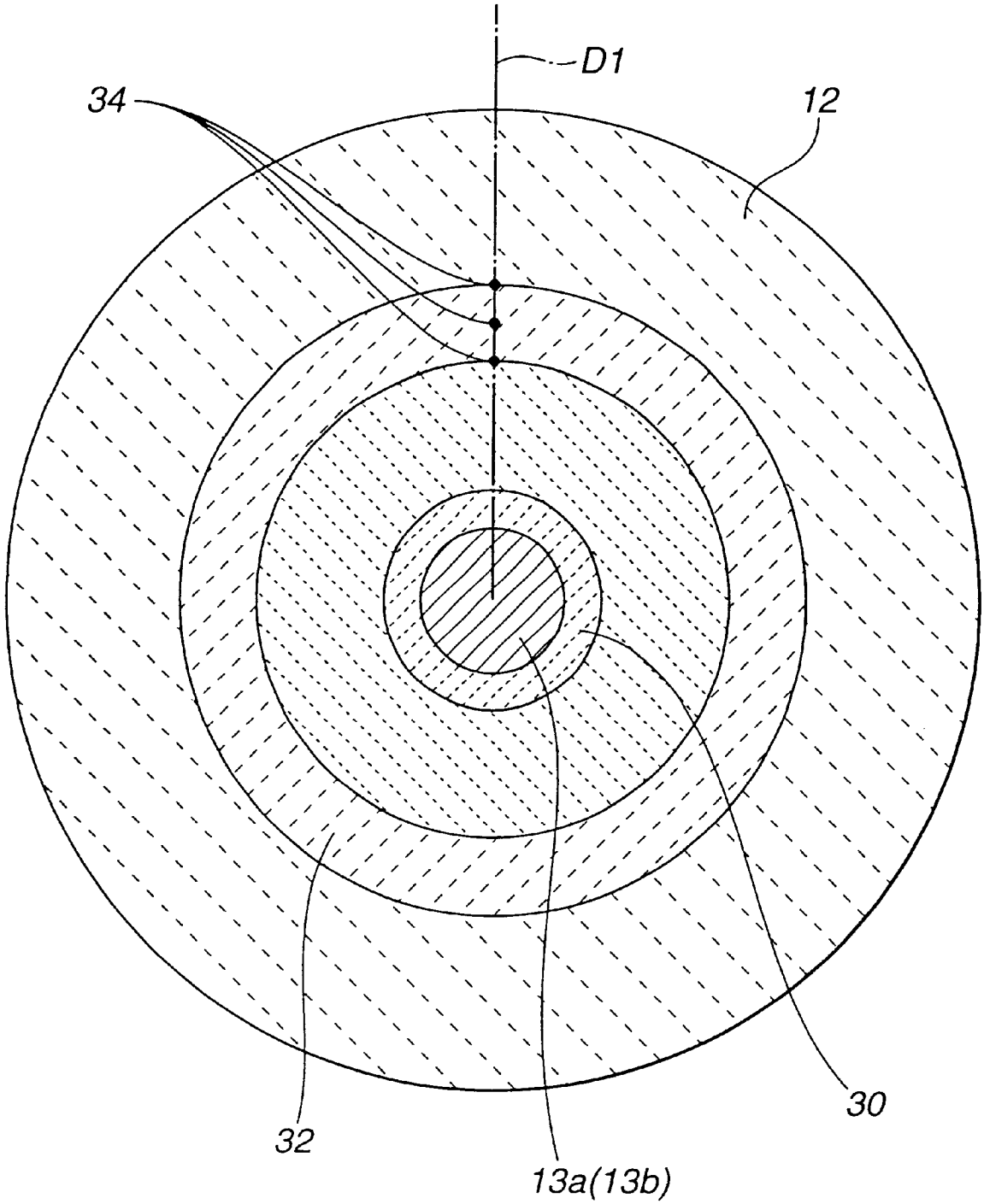
FIG. 6 is an enlarged schematic view showing a part of a cross-section, taken by lines X—X of FIG. 4, of a ceramic heater according to the present invention.

As is seen from FIGS. 4 and 6, the inventors unexpectedly found that a condensed zone 30 may be formed in the heating element 12 at a periphery of a lead wire's end portion embedded in the heating element 12. This condensed zone 30 has a higher concentration of the particular element (e.g., a rare-earth element contained in the sintering aid), as compared with that of a reference zone 32 of the heating element 12. To define more properly, the condensed zone 30 is a zone such that the concentration of the particular element contained in the matrix ceramic phase of the condensed zone 30 is two times or greater the average concentration of the particular element contained in the matrix ceramic phase of the reference zone 32. This average concentration of the reference zone 32 can be defined as that of at least two points 34 (three points shown in FIG. 6) of the reference zone 32, which are arranged in a direction along the thickness of the reference zone 32. This direction D1 can defined as being the radial direction of the end portion of the lead wire 13*a* or 13*b*. As shown in FIG. 6, each of the condensed zone 30 and the reference zone 32 can be defined on a cross-section of the ceramic heater 1. This cross-section can be defined as being perpendicular to the axial direction of the ceramic heater 1 and as being disposed at a center (with respect to the axial direction of the ceramic heater) of the lead wire's end portion embedded in the heating element 12. The reference zone 32 is spaced away from the lead wire's end portion by a distance of 40 $\mu$m or greater in the radial direction D1 such that the reference zone 32 can be a proper reference zone with respect to the concentration of the particular element of the heating element 12, relative to that of the condensed zone 30. To describe more properly, the position and the thickness (defined in the direction D1) of the reference zone 32 can suitably be adjusted in order that the average concentration of the particular element contained in the matrix ceramic phase of the reference zone 32 becomes a proper reference average concentration of a major part (except the condensed zone 30) of the heating element, relative to the concentration of the particular element contained in the matrix ceramic phase of the condensed zone 30.

The inventors further unexpectedly found that bending strength of the ceramic heater 1, particularly that of its connected portion at which the lead wire's end portion is embedded in the heating element 12, can sufficiently be improved, when the ceramic heater 1 is free from such condensed zone 30, or when the condensed zone 30 has a thickness of not greater than 5 $\mu$m. This thickness of the condensed zone 30 can be defined in the radial direction D1 of the lead wire's end portion. It is possible to use such ceramic heater, which is improved in bending strength, for a heating source of a diesel engine glow plug and for other various uses (e.g., heaters). Furthermore, the ceramic heater according to the invention can have a small variation or dispersion of bending strength. Thus, a glow plug equipped with such ceramic heater can be used stably for a long time. If the thickness of the condensed zone 30 is greater than 5 $\mu$m, the retainment or fixation of the lead wire's end portion by the matrix ceramic (e.g., silicon-nitride-based sintered body) of the heating element 12 may become insufficient. With this, bending strength of the ceramic heater at its connected portion may be lowered. As explained hereinafter, the thickness of the condensed zone 30 can be determined by a linear analysis using an electron probe microanalyzer (EPMA).

The inventors have unexpectedly found that it becomes possible to make the heating element 12 free from the condensed zone 30 or at least to minimize the formation of the condensed zone 30 to have a thickness of not greater than 5 $\mu$m by adjusting a particular ratio (Rh/Ri) to 0.5 or less, preferably 0.48 or less, more preferably 0.45 or less. With this, it becomes possible to prevent bending strength from lowering. The ratio (Rh/Ri) is defined as being a ratio of the weight percentage (Rh) of a rare-earth element contained in a major part (except the condensed zone 30) of the heating element 12 to the weight percentage (Ri) of a rare-earth element contained in the basal body 11. If the ratio (Rh/Ri) is 0.48 or less, particularly 0.45 or less, the condensed zone 30 is substantially not formed (see FIG. 1). With this, it becomes possible to assuredly prevent bending strength from lowering. No formation of the condensed zone 30 can be checked by the observation of the periphery of the lead wire's end portion with an electron microscope. With a ratio (Rh/Ri) of 0.48 or less, particularly 0.45 or less, it becomes possible to have a minimum bending strength of 700 MPa or greater, particularly 750 MPa or greater, and an average bending strength of 750 MPa or greater, particularly 800 MPa or greater. Furthermore, it becomes possible to make the ceramic heater have a small variation or dispersion of bending strength. Such ceramic heater can have a difference between the average bending strength and the minimum one of 100 MPa or less, particularly 85 MPa or less, more particularly 60 MPa or less. If the ratio (Rh/Ri) is greater than 0.5, the condensed zone 30 may be formed, thereby lowering bending strength (see FIG. 2). The above-mentioned Rh and Ri can be determined by qualitative and quantitative analyses with EPMA.

The reason of the formation of the condensed zone 30 at the periphery of the lead wire's end portion can be assumed as follows. Although each lead wire 13*a* or 13*b* is made of a high-melting point metal (e.g., W), it may be impossible during sintering to prevent a reaction between the lead wire's surface and a component(s) contained in a precursor of the heating element, thereby producing a small amount of a reaction product and causing a small volume change. This may cause a textural defect zone at the periphery of the lead wire's end portion, and the sintering aid component (e.g., rare-earth oxides) may accumulate in the textural defect zone. With this, the textural defect zone becomes the condensed zone.

As mentioned above, the condensed zone tends to be formed as the ratio (Rh/Ri) increases. The reason of this can be assumed as follows. If Ri becomes smaller to increase this ratio, sinterability of the basal body is lowered. Thus, it is necessary to have a more time to make the whole ceramic heater compact to complete sintering. During such sintering, various components tend to move. In particular, a rare-earth oxide(s) tends to move and accumulate in the above textural defect zone, thereby forming the condensed zone. If Rh becomes larger to make the ratio greater than 0.5, a precursor of the heating element is improved in sinterability. With this, it becomes possible to have a less time to make the whole ceramic heater compact to complete sintering. The sintered body after completion of compaction (sintering) is, however, maintained at a high temperature for a certain period of time. Therefore, the rare-earth oxide(s) of the heating element tends to move to the basal body and thereby uniformly disperse throughout the ceramic heater, thereby lowering the rare-earth concentration of the heating element. However, only rare-earth oxide(s) of the textural defect zone may not move or disperse sufficiently, thereby forming the condensed zone. Therefore, it is preferable to adjust the ratio (Rh/Ri) to 0.5 or less.

An exemplary process for producing the ceramic heater will be described in detail in accordance with the invention, as follows. In this process, a powder mixture for producing the heating element can be prepared by mixing together 15–40 volume percent, particularly 20–30 volume percent, of a powder for the conductive ceramic particles and 60–85 volume percent, particularly 70–80 volume percent, of a total of a powder for the matrix ceramic phase and a sintering aid powder, based on the total volume of these three powders, by a conventional mixing method (e.g., wet mixing). Then, a suitable amount of a binder and if necessary other additives are added to the powder mixture, followed by kneading and then pelletization. The resulting pellets are formed into a compact for the heating element by, for example, injection molding, while the lead wires are positioned at predetermined positions in a die for injection molding, thereby obtaining a first precursory body in which the lead wire's end portions are embedded in the compact. Then, the first precursory body is brought into embedding in a raw material for the basal body. This embedding can be conducted by providing two halves of a molded powder compact for the basal body and then disposing the first precursory body between the two halves, followed by pressing and then adding pressure until about 5–12 MPa, thereby obtaining a second precursory body. Then, the second precursory body is placed in a pressing die of graphite or the like, followed by a hot press sintering in a sintering furnace, thereby producing a ceramic heater. This sintering can be conducted at a temperature of 1,700–1,850° C., particularly 1,800–1,850° C., for 30–180 minutes, particularly 60–120 minutes.

The following nonlimitative examples are illustrative of the present invention.

EXAMPLES 1–9

In each of these examples, a raw material for the matrix ceramic phase of the heating element was prepared by adding a sintering aid ($Yb_2O_3$ power and $SiO_2$ power in amounts shown in Table) to a silicon nitride powder. Then, 40 wt % of this raw material were mixed with 60 wt % of a WC powder as a raw material for the conductive ceramic particles in a wet manner for 72 hr, followed by drying, thereby obtaining a powder mixture. Then, this powder mixture and a binder were kneaded for 4 hr in a kneader, followed by pelletization to obtain pellets. Then, two lead wires made of tungsten were disposed relative to a die containing a U-shaped cavity in a manner that an end portion of each lead wire is in the cavity by a length of about 3 mm. Under this condition, an injection molding was conducted by forcing the obtained pellets into the cavity, thereby obtaining a first precursory body in which the end portion of each lead wire is embedded in an U-shaped compact for the heating element.

Separately, a raw material for the basal body was prepared by adding a sintering aid (i.e., 11 parts by weight (4 parts by volume) of $Yb_2O_3$ powder and 3 parts by weight of $SiO_2$ powder) and 5 parts by weight of $MoSi_2$ powder to 86 parts by weight of a silicon nitride powder, followed by a wet mixing for 40 hr and then pelletization by a spray dryer method. The resulting pellets were formed into two halves of a powder compact for the basal body. Then, the first precursory body was placed between these two halves, followed by press molding and then uniformly pressing at a pressure of 70 atmospheres, thereby obtaining a second precursory body (i.e., a ceramic heater prior to sintering). Then, the second precursory body was subjected to a preliminary sintering at 600° C. to remove the binder. The resulting body was placed in a pressing die (made of graphite) and then subjected to a hot press sintering under nitrogen atmosphere at 1,800° C. for 1.5 hr, thereby producing a ceramic heater shown in FIG. 4.

Figure 1:
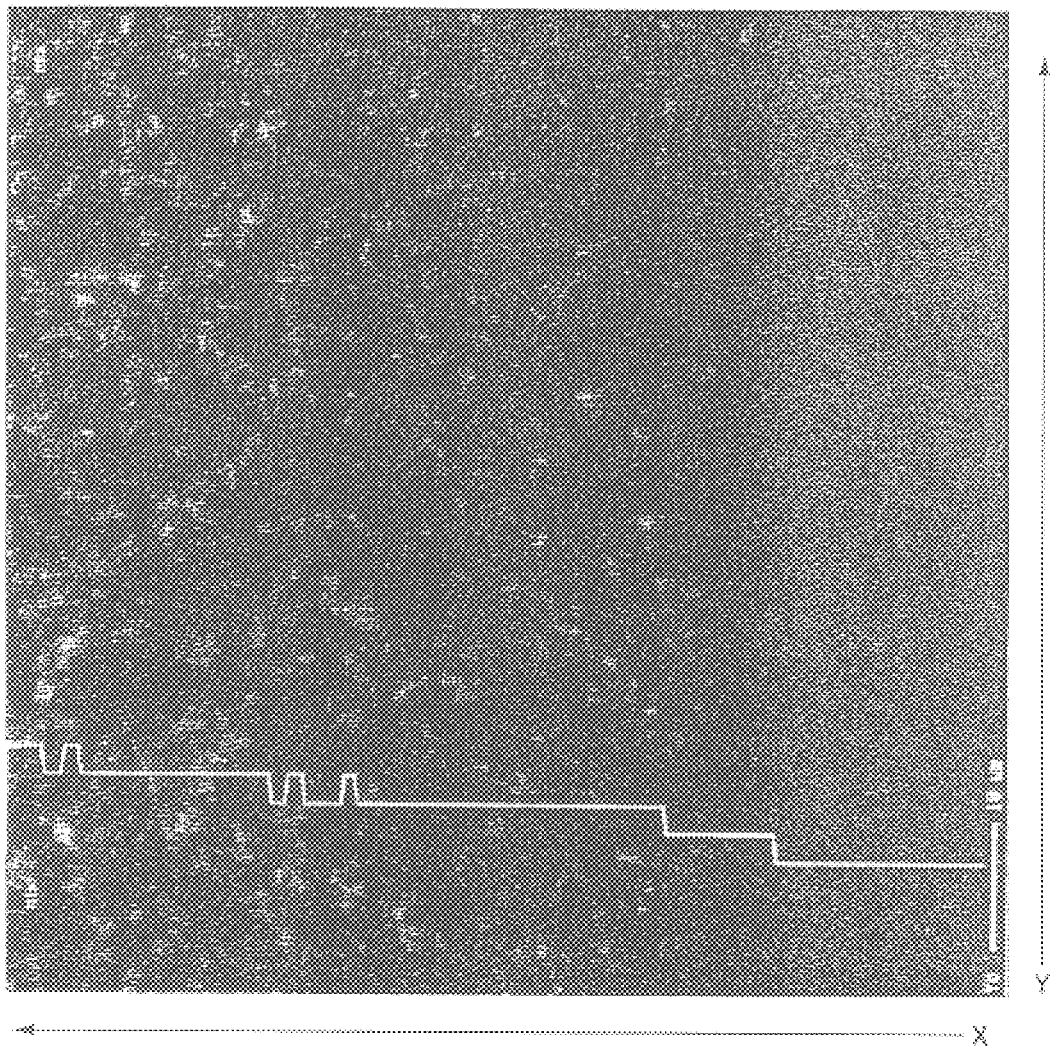
FIG. 1 is a photograph of 500 magnifications, taken by a scanning electron microscope, showing a part of a cross-section, taken by lines X—X of FIG. 4, of a ceramic heater according to Example 4.
Figure 2:
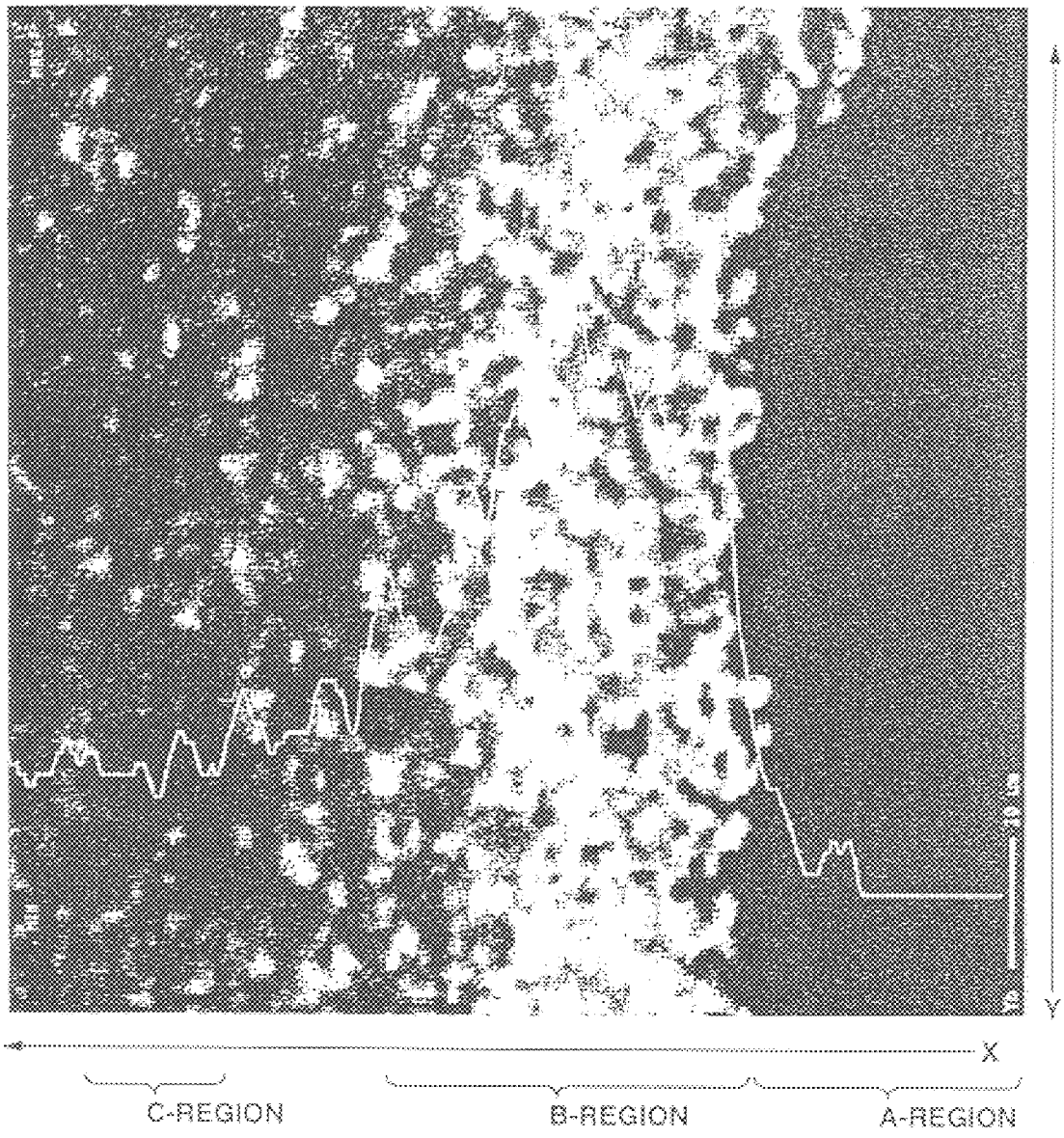
FIG. 2 is a photograph similar to FIG. 1, but showing that of a ceramic heater according to Example 9.

Each of the obtained ceramic heaters according to Examples 1–9 was cut in a radial direction of the ceramic heater at an axial center (position: 1.5 mm from the lead wire's end) of the lead wire's end portion (length: about 3 mm) embedded in the heating element, thereby obtaining a cross-section of lines X—X of FIG. 4. This cross-section was observed with a scanning electron microscope, and its photograph was taken, as shown in FIGS. 1 and 2. This photograph shows a condition of the periphery of the lead wire's end portion. Furthermore, the variation or distribution of the Yb concentration on the cross-section was determined by an element mapping using EPMA. In FIGS. 1 and 2, the variation of the relative Yb concentration (of an arbitrary scale) on the cross-section was superimposed on the photograph. In FIGS. 1 and 2, X-axis extends outwardly in the radial direction D1 of the lead wire's end portion. Y-axis is perpendicular to X-axis and also indicates relative Yb concentration on an arbitrary scale. In FIG. 2, A-region, B-region and C-region correspond to the lead wire, the condensed zone, and the reference zone, respectively. In other words, B-region (a whitish zone) of FIG. 2 was judged as being the condensed zone from the photograph of FIG. 2 and high Yb concentrations of FIG. 2. In fact, FIG. 2 can be interpreted as that the reference zone (C-region) of a thickness of 10 $\mu$m, which is away from the lead wire by a distance of about 40 $\mu$m, has an average Yb concentration of about 11 level, and in contrast the condensed zone (B-region) of a thickness of about 28 $\mu$m has an average Yb concentration of about 30 level. That is why B-region of FIG. 2 was judged as being the condensed zone. In contrast with FIG. 2, FIG. 1 was interpreted as having no condensed zone from the photograph and the Yb concentration. The results of the condensed zone thickness according to the other examples are also shown in Table.

Figure 3:
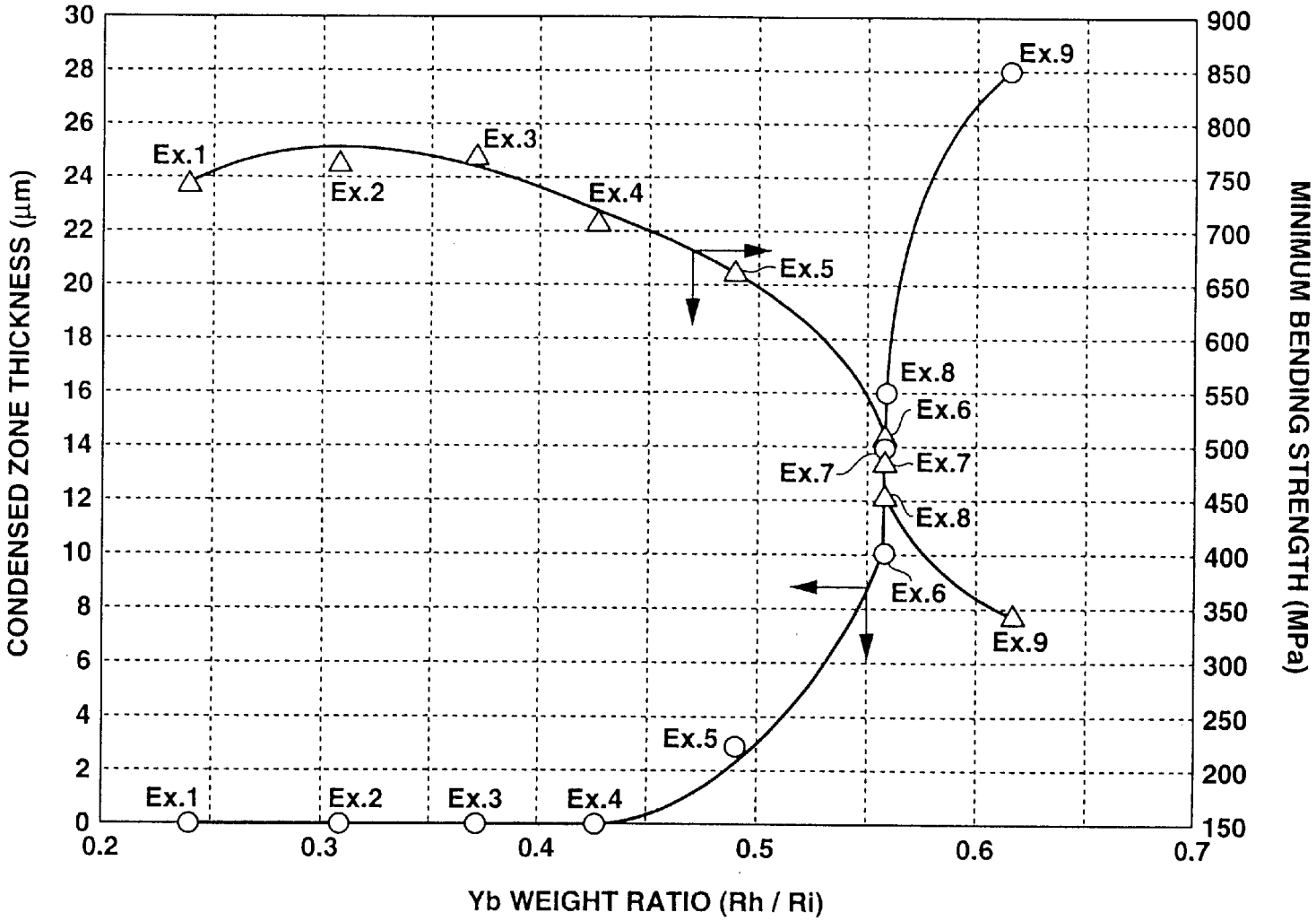
FIG. 3 is a graph showing a relationship between (a) the thickness of the condensed zone of a ceramic heater according to each of Examples 1–9 and (b) the minimum value of bending strength at the lead wire's end portion of a ceramic heater according to each of Examples 1–9.

Each ceramic heater was subjected to a bending strength test in accordance with Japanese Industrial Standard (JIS) R 1601. In this test, a three-point bending strength was measured with a 12 mm span and a 0.5 mm/min cross-head speed. The results are shown in Table. The minimum and average bending strengths of the ceramic heater at the lead wire's end portion, and the value obtained by subtracting the minimum from the average are shown in Table. Partial data (i.e., Rh/Ri of Yb, the condensed zone thickness, and the minimum bending strength) of Table are also shown in FIG. 3.

TABLE

| | Sintering Aid in Heating Element Raw Material | | | | Ceramic Heater Bending Strength at Lead Wire's |
|---|---|---|---|---|---|
| | $Yb_2O_3$ (parts by wt/parts by volume) | $SiO_2$ (parts by wt) | Rh/Ri of Yb* | Condensed Zone Thickness ($\mu$m) | End Portion (MPa) Min./Ave./ Ave. – Min. |
| Ex. 1 | 8/2.34 | 3.5 | 0.24 | 0 | 741/823/ 82 |
| Ex. 2 | 10/2.97 | 3.5 | 0.31 | 0 | 762/844/82 |
| Ex. 3 | 12/3.62 | 3.5 | 0.37 | 0 | 770/814/44 |
| Ex. 4 | 14/4.28 | 3.5 | 0.45 | 0 | 715/799/84 |
| Ex. 5 | 16/4.97 | 3.5 | 0.49 | 3 | 665/741/76 |
| Ex. 6 | 18/5.60 | 3.5 | 0.56 | 10 | 512/634/122 |
| Ex. 7 | 18/5.68 | 2.7 | 0.56 | 14 | 487/667/180 |
| Ex. 8 | 18/5.75 | 4.3 | 0.56 | 16 | 455/597/142 |
| Ex. 9 | 20/6.41 | 3.5 | 0.62 | 28 | 342/488/146 |

*Rh/Ri of Yb: the weight ratio of Yb contained in the heating element to Yb contained in the basal body The entire disclosure of Japanese Patent Application No. 2000-16163 filed on Jan. 25, 2000, including specification, claims, drawings and summary, is incorporated herein by reference in its entirety.

What is claimed is:

1. A ceramic heater extending in an axial direction to have an elongate shape, said ceramic heater comprising:

(a) a basal body;

(b) a lead wire embedded in said basal body; and (c) a heating element embedded in said basal body, said heating element comprising:

(1) a matrix ceramic phase;

(2) conductive ceramic particles dispersed in said matrix ceramic phase;

(3) a portion in which an end portion of said lead wire is embedded;

(4) a reference zone defined on a cross-section of said ceramic heater, said cross-section being defined as being perpendicular to said axial direction of said ceramic heater and as being disposed at a center of said end portion of said lead wire, said reference zone being away from said end portion of said lead wire by a distance of 40 $\mu$m or greater; and (5) a condensed zone optionally contained in said heating element and having a thickness of 5 $\mu$m or less, said condensed zone being defined on said cross-section of said ceramic heater and defined as being a zone such that a concentration of an element contained in said matrix ceramic phase of said condensed zone is two times or greater an average concentration of said element contained in said matrix ceramic phase of said reference zone, said average concentration being defined in a direction along a thickness of said reference zone.

2. A ceramic heater according to claim 1, wherein each of said element of said reference zone and that of said condensed zone is a rare-earth element.

3. A ceramic heater according to claim 2, wherein said rare-earth element is ytterbium or erbium.

4. A ceramic heater according to claim 1, wherein a ratio of a weight percentage of a rare-earth element contained in said heating element to a weight percentage of said rare-earth element contained in said basal body is 0.5 or less.

5. A ceramic heater according to claim 4, wherein said ratio is 0.45 or less.

6. A ceramic heater according to claim 1, wherein said heating element is free from said condensed zone.

7. A ceramic heater according to claim 1, wherein said matrix ceramic phase is a silicon-nitride-based sintered body.

8. A ceramic heater according to claim 1, wherein said conductive ceramic particles are prepared by sintering a material that is at least one compound of at least one metal, said at least one compound being selected from the group consisting of silicides, carbides and nitrides, said at least one metal being selected from the group consisting of W, Ta, Nb, Ti, Mo, Zr, Hf, V and Cr.

9. A ceramic heater according to claim 8, wherein said at least one compound is selected from the group consisting of WC, $MoSi_2$, TiN, and $WSi_2$.

10. A ceramic heater according to claim 1, wherein said lead wire is made of a material that is a metal or an alloy comprising said metal, said metal being at least one selected from the group consisting of W, Re, Ta, Mo and Nb.

11. A ceramic heater according to claim 1, wherein said basal body is a silicon-nitride-based sintered body.

12. A ceramic heater according to claim 1, wherein each of said reference zone and said condensed zone is annular in shape to surround said end portion of said lead wire, and wherein said condensed zone is disposed between said reference zone and said end portion of said lead wire in a radial direction of said end portion of said lead wire.

13. A ceramic heater according to claim 1, wherein said thickness of said reference zone and that of said condensed zone are each defined in a radial direction of said end portion of said lead wire.

14. A ceramic heater according to claim 1, wherein said average concentration is defined as that of at least two points of said reference zone, said at least two points being arranged in said direction along said thickness of said reference zone.

15. A glow plug equipped with a ceramic heater according to claim 1.

16. A process for producing a ceramic heater extending in an axial direction to have an elongate shape, said ceramic heater comprising:

(a) a basal body;

(b) a lead wire embedded in said basal body; and (c) a heating element embedded in said basal body, said heating element comprising:

(1) a matrix ceramic phase;

(2) conductive ceramic particles dispersed in said matrix ceramic phase;

(3) a portion in which an end portion of said lead wire is embedded;

(4) a reference zone defined on a cross-section of said ceramic heater, said cross-section being defined as being perpendicular to said axial direction of said ceramic heater and as being disposed at a center of said end portion of said lead wire, said reference zone being away from said end portion of said lead wire by a distance of 40 $\mu$m or greater; and (5) a condensed zone optionally contained in said heating element and having a thickness of 5 $\mu$m or less, said condensed zone being defined on said cross-section of said ceramic heater and defined as being a zone such that a concentration of an element contained in said matrix ceramic phase of said condensed zone is two times or greater an average concentration of said element contained in said matrix ceramic phase of said reference zone, said average concentration being defined in a direction along a thickness of said reference zone, said process comprising:

providing a first precursor of said heating element, said first precursor comprising a first weight percent of a rare-earth element;

embedding said end portion of said lead wire in said first precursor to form a first precursory body;

embedding said first precursory body in a second precursor of said basal body to form a second precursory body, said second precursor comprising a second weight percent of a rare-earth element, a ratio of said first weight percent to said second weight percent being 0.5 or less; and sintering said second precursory body into said ceramic heater.

17. A process according to claim 16, wherein said ratio is 0.45 or less.

18. A process according to claim 16, wherein each rare-earth element of said first and second precursors is ytterbium or erbium.

19. A process according to claim 16, wherein said first precursor of said heating element comprises a silicon-nitride-based ceramic that is a precursor of said matrix ceramic phae of said heating element.

20. A process according to claim 16, wherein said first precursor of said heating element comprises a material that is at least one compound of at least one metal, said at least one compound being selected from the group consisting of silicides, carbides and nitrides, said at least one metal being selected from the group consisting of W, Ta, Nb, Ti, Mo, Zr, Hf, V and Cr, said material being a precursor of said conductive ceramic particles.

21. A process according to claim 20, whereni said at least one compound is selected from the group consisting of WC, $MoSi_2$, TiN, and $WSi_2$.

22. A process according to claim 16, wherein said lead wire is made of a material that is a metal or an alloy comprising said metal, said metal being at least one selected from the group consisting of W, Re, Ta, Mo and Nb.

23. A process according to claim 16, wherein said second precursor of said basal body comprises a silicon-nitride-based ceramic.

* * * * *